United States Patent [19]

Zaweski

[11] 4,208,293

[45] Jun. 17, 1980

[54] IMPROVED CRANKCASE LUBRICANT COMPOSITION

[75] Inventor: Edward F. Zaweski, Pleasant Ridge, Mich.

[73] Assignee: Ethyl Corporation, Richmond, Va.

[21] Appl. No.: 959,935

[22] Filed: Nov. 13, 1978

[51] Int. Cl.[2] ..... C10M 1/32

[52] U.S. Cl. ..... 252/51.5 A

[58] Field of Search ..... 252/51.5 A

[56] References Cited

U.S. PATENT DOCUMENTS

| | | | |
|---|---|---|---|
| 1,985,687 | 12/1934 | Nuesslein et al. | 252/51.5 A X |
| 2,018,758 | 10/1935 | Ellis | 252/51.5 A |
| 2,403,067 | 7/1946 | Fischer et al. | 252/51.5 A |
| 2,967,831 | 1/1961 | Hommer | 252/51.5 A X |
| 3,324,033 | 6/1967 | Knapp | 252/51.5 A |
| 3,458,444 | 7/1969 | Shepherd et al. | 252/51.5 A |
| 3,509,052 | 4/1970 | Murphy | 252/34.7 |
| 3,542,628 | 11/1970 | Bork | 252/51.5 A |
| 3,746,644 | 7/1973 | Magne et al. | 252/51.5 A X |

*Primary Examiner*—Andrew Metz

*Attorney, Agent, or Firm*—Donald L. Johnson; Robert A. Linn; Joseph D. Odenweller

[57] ABSTRACT

Lubricating oil adapted for use as a crankcase lubricant in internal combustion engines containing a friction-reducing amount of a fatty acid amide or ester of diethanolamine.

2 Claims, No Drawings

IMPROVED CRANKCASE LUBRICANT COMPOSITION

BACKGROUND

In order to conserve energy, automobiles are now being engineered to give improved gasoline mileage compared to those in recent years. This effort is of great urgency as a result of Federal regulations recently enacted which compel auto manufacturers to achieve prescribed gasoline mileage. These regulations are to conserve crude oil. In an effort to achieve the required mileage, new cars are being down-sized and made much lighter. However, there are limits in this approach beyond which the cars will not accommodate a typical family.

Another way to improve fuel mileage is to reduce engine friction. The present invention is concerned with this latter approach.

Polyethoxylated oleamide containing an average of 5 oxyethylene units is commercially available under the name "Ethomid" (registered trademark, Armak Company). Reference to its use as a demulsifier in lubricating oil appears in U.S. Pat. No. 3,509,052.

SUMMARY

According to the present invention lubricating oils are provided which reduce friction between sliding metal surfaces in internal combustion engines. The reduced friction results from the addition to the lubricating oil of a small amount of a fatty acid amide or ester of diethanol amine.

DESCRIPTION OF THE PREFERRED EMBODIMENTS

A preferred embodiment of the invention is a lubricating oil composition comprising a major amount of lubricating oil and a minor friction-reducing amount of an oil-soluble additive selected from the group consisting of fatty acid amides of diethanolamine, fatty acid esters of diethanol amine and mixtures thereof.

The additives can be made by forming a mixture of a fatty acid and diethanol amine and heating the mixture to remove water. Optionally, a water immiscible inert solvent such as toluene or xylene can be included to aid in the removal of water.

About 1–3 moles of fatty acid are used per mole of diethanolamine. The reaction proceeds to yield mainly amide according to the following equation $$R{-}COOH + HN{-}(C_2H_4OH)_2 \longrightarrow R\overset{O}{\overset{\|}{C}}{-}N{-}(C_2H_4OH)_2$$

wherein R is a hydrocarbon residue of the fatty acid.

Some of the diethanol amine can react to form ester according to the following equation $$RCOOH + HN{-}(C_2H_4OH)_2 \longrightarrow R\overset{O}{\overset{\|}{C}}{-}OC_2H_4{-}NH{-}C_2H_4OH\,.$$

The components can be separated by distillation and used separately in lubricating oil compositions. Preferably, they are not separated, but are used as mixtures. The mixtures can also contain fatty acid ester-amides of diethanol amine. When equal mole mixtures of fatty acid and diethanol amine are reacted very little ester-acid forms. However, when over one mole of fatty acid is reacted with a mole of diethanol amine increased amounts of ester-amide can form according to the following equations $$2\,RCOOH + HN{-}(C_2H_4OH)_2 \longrightarrow R\overset{O}{\overset{\|}{C}}{-}N(C_2H_4OH){-}C_2H_4O{-}\overset{O}{\overset{\|}{C}}{-}R$$

$$3\,RCOOH + HN{-}(C_2H_4OH)_2 \longrightarrow R\overset{O}{\overset{\|}{C}}{-}N{-}(C_2H_4O{-}\overset{O}{\overset{\|}{C}}R)_2$$

Such ester-amides are within the scope of the invention.

Preferred fatty acids used in making the friction-reducing additive are those containing about 8–20 carbon atoms. Examples of these are caprylic acid, pelargonic acid, capric acid, undecylic acid, lauric acid, tridecoic acid, myristic acid, stearic acid, arachidic acid and the like.

More preferably the fatty acid is an unsaturated fatty acid such as hypogeic acid, oleic acid, elaidic acid, erucic acid, brassidic acid and the like.

More preferably the fatty acid is oleic acid. Thus, the preferred additives are N,N-bis-(2-hydroxyethyl)oleamide, N-(2-hydroxyethyl)aminoethyl oleate and mixtures thereof.

EXAMPLE 1

In a reaction vessel was placed 52.5 gms (0.5 mol) of diethanol amine and 141 gms (0.5 mol) of oleic acid (caution exotherm). The mixture was stirred under nitrogen and heated to 188° C. over a two-hour 13-minute period while distilling out water. The resultant product was mainly N,N-(2-hydroxyethyl)oleamide containing about 35 weight percent N-(2-hydroxyethyl)aminoethyl oleate. These components can be separated by distillation.

EXAMPLE 2

In a reaction vessel was placed 282 gms of oleic acid, 105 gms diethanol amine and a small amount of xylene. The mixture was stirred under nitrogen and heated from 165°–185° C. over a two-hour period while distilling out water and returning xylene. The xylene was then stripped from the mixture under vacuum leaving 363 gms of a viscous liquid product consisting mainly of N,N-bis-(2-hydroxyethyl)oleamide and about 36 weight percent of N-(2-hydroxyethyl)aminoethyl oleate.

Other fatty acids can be substituted for oleic acid in the above examples with good results. Alternatively, the amide can be made by reacting one mole of oleamide with about two moles of ethylene oxide. The additives are used in an amount sufficient to reduce the sliding friction of metal surfaces lubricated by oil containing the additive. An effective concentration is about 0.05–5 weight percent. More preferably, the use concentration is about 0.2–1 weight percent.

The base lubricating oil may be mineral lubricating oil or synthetic lubricating oil. Useful mineral oils include all those of suitable lubricating viscosity. Representative synthetic oils include olefin oligomers such as $\alpha$-decene trimer and tetramer, alkyl benzenes such as didodecyl benzene, esters such as dinonyl adipate, trimethylol propane tripelargonate, and complex esters made from polycarboxylic acids and polyols with a monocarboxylic acid or monohydric alkanol end group.

Blends of mineral oil and synthetic oil are very useful. For example, a blend of about 80% 150 SUS mineral oil and 20% α-decene trimer gives a very useful base lubricating oil. Likewise, blends of synthetic esters with mineral oil are very useful. For example, a blend of 15 weight percent di-2-ethylhexyl adipate and 85 weight percent 150 SUS mineral oil is a very effective base lubricating oil for use in an engine crankcase.

Improved results are obtained when a zinc dihydrocarbyl dithiophosphate (ZDDP) is used in combination with the present additives. The amount can very over a wide range. It is usually expressed in terms of zinc content of the oil. Formulated oil would include 0.01–0.3 weight percent zinc as ZDDP. A preferred range is about 0.05–0.15 weight percent zinc.

The ZDDP may be aryl type or alkyl type. A representative aryl type ZDDP is zinc di-nonylphenyl dithiophosphate. Preferably, an alkyl type ZDDP is used. Examples of these are zinc isobutyl amyl dithiophosphate, zinc di-(2-ethylhexyl)dithiophosphate and the like.

Other additives may be included such as alkaline earth metal phenates and sulfurized phenates, alkaline earth hydrocarbyl sulfonates such as calcium petroleum sulfonate, magnesium alkyl benzene sulfonate, overbased calcium alkyl benzene sulfonate and the like. Phosphosulfurized terpene and polyolefins and their alkaline earth metal salts may be included. Viscosity index improvers such as the poly-alkyl methacrylate or ethylene-propylene copolymers, ethylene-propylene non-conjugated diene terpolymers are also useful VI improvers in lubricating oil. Antioxidants such as 4,4'-methylenebis-(2,6-di-tert-butylphenol) can be beneficially added to the lubricating oil.

Tests were carried out which demonstrated the friction-reducing properties of the additives. These tests have been found to correlate with fuel economy tests in automobiles. In these tests an engine with its cylinder head removed and with the test lubricating oil in its crankcase was brought to 1800 rpm by external drive. Crankcase oil was maintained at 63° C. The external drive was disconnected and the time to coast to a stop was measured. This was repeated several times with the base oil and then several times with the same oil containing one percent of a mixture prepared as described in Example 2. The base oil was a typical commercial oil formulated for use in a crankcase. The friction-reducing additive was found to increase the coast-down time an average of 4.3%.

I claim:

1. In a lubricating oil formulated for use in the crankcase of an internal combustion engine, the improvement of including in said formulated oil about 0.05–5 wt % of a fatty acid amide of diethanol amine wherein said fatty acid contains 8–20 carbon atoms wherein engine friction is reduced.

2. A composition of claim 1 wherein said additive is N,N-bis-(2-hydroxyethyl)oleamide.

* * * * *